US010640922B2

(12) United States Patent
Traxl et al.

(10) Patent No.: US 10,640,922 B2
(45) Date of Patent: May 5, 2020

(54) HYBRID STRANDED CONDUCTOR

(71) Applicant: TEUFELBERGER SEIL GESELLSCHAFT M.B.H., Wels (AT)

(72) Inventors: Robert Traxl, Ebensee (AT); Gunter Kaiser, Thalheim bei Wels (AT); Rudolf Kirth, Voecklabruck (AT); Bjoern Ernst, Linz (AT); Erich Ruehrnoessl, Haid (AT); Peter Baldinger, Schwertberg (AT)

(73) Assignee: TEUFELBERGER SEIL GESELLSCHAFT M.B.H., Wels (AT)

( * ) Notice: Subject to any disclaimer, the term of this patent is extended or adjusted under 35 U.S.C. 154(b) by 152 days.

(21) Appl. No.: 15/746,517

(22) PCT Filed: Jul. 21, 2016

(86) PCT No.: PCT/AT2016/060012

§ 371 (c)(1),
(2) Date: Jan. 22, 2018

(87) PCT Pub. No.: WO2017/011847

PCT Pub. Date: Jan. 26, 2017

(65) Prior Publication Data

US 2018/0209093 A1 Jul. 26, 2018

(30) Foreign Application Priority Data

Jul. 23, 2015 (AT) ..... A 50649/2015

(51) Int. Cl.
*D07B 5/00* (2006.01)
*D07B 1/00* (2006.01)
(Continued)

(52) U.S. Cl.
CPC ..... *D07B 5/007* (2013.01); *D07B 1/005* (2013.01); *D07B 1/165* (2013.01); *D07B 7/027* (2013.01);
(Continued)

(58) Field of Classification Search
CPC ..... D07B 1/005; D07B 1/0646; D07B 5/007
See application file for complete search history.

(56) References Cited

U.S. PATENT DOCUMENTS 338,913 A * 3/1886 Batchelor ..... D07B 5/007 57/215
3,142,145 A 7/1964 Blanchard
(Continued)

FOREIGN PATENT DOCUMENTS

AT 516 444 A1 5/2016
CN 85 100 309 A 3/1987
(Continued)

OTHER PUBLICATIONS

Notification of Reason for Refusal in KR 20187005472 (dated Apr. 16, 2019).
(Continued)

*Primary Examiner* — Shaun R Hurley
(74) *Attorney, Agent, or Firm* — Collard & Roe, P.C.

(57) ABSTRACT

A hybrid strand includes a core and outer wires arranged around the core, wherein at least a part of the outer wires is compressed, wherein the compressed outer wires include a flattened cross-sectional shape, the outer wires are composed of steel, and the core is a fiber core. A corresponding production method produces such a hybrid strand.

6 Claims, 5 Drawing Sheets

(51) Int. Cl.

| | |
|---|---|
| ***D07B 7/02*** | (2006.01) |
| ***D07B 1/16*** | (2006.01) |
| ***H01B 5/10*** | (2006.01) |
| ***H01B 13/02*** | (2006.01) |

(52) U.S. Cl.
CPC ..... *H01B 5/104* (2013.01); *H01B 13/0207* (2013.01); *D07B 2201/204* (2013.01); *D07B 2201/2019* (2013.01); *D07B 2201/2039* (2013.01); *D07B 2201/2041* (2013.01); *D07B 2201/2055* (2013.01); *D07B 2205/3025* (2013.01); *D07B 2401/2015* (2013.01)

(56) References Cited

U.S. PATENT DOCUMENTS

| | | | | | |
|---|---|---|---|---|---|
| 4,034,547 | A * | 7/1977 | Loos | D07B 1/0693 | 57/211 |
| 4,120,145 | A * | 10/1978 | Chiappetta | D07B 1/0673 | 57/221 |
| 4,270,341 | A * | 6/1981 | Glushko | D07B 1/068 | 57/215 |
| 4,311,001 | A | 1/1982 | Glushko et al. | | |
| 4,807,680 | A * | 2/1989 | Weidenhaupt | D02G 3/48 | 152/451 |
| 4,887,422 | A * | 12/1989 | Klees | D07B 1/025 | 57/220 |
| 5,806,296 | A * | 9/1998 | Kaneko | D07B 1/062 | 57/206 |
| 5,946,898 | A | 9/1999 | Kurata et al. | | |
| 6,247,359 | B1 | 6/2001 | De Angelis | | |
| 7,594,380 | B2 * | 9/2009 | Barguet | D02G 3/48 | 152/451 |
| 8,079,208 | B2 * | 12/2011 | Volpi | B60C 9/0042 | 57/222 |
| 8,176,718 | B2 | 5/2012 | Ridge et al. | | |
| 9,506,188 | B2 * | 11/2016 | Pourladian | D07B 1/0686 | |
| 2001/0017027 | A1 * | 8/2001 | Misrachi | D07B 1/0673 | 57/215 |
| 2012/0085077 | A1 * | 4/2012 | Pourladian | D07B 1/144 | 57/214 |
| 2014/0260175 | A1 * | 9/2014 | Pourladian | D07B 1/0686 | 57/222 |
| 2017/0328001 | A1 | 11/2017 | Kirth et al. | | |

FOREIGN PATENT DOCUMENTS

| | | | |
|---|---|---|---|
| CN | 1 141 982 | A | 2/1997 |
| DE | 125643 | C | 12/1901 |
| DE | 1 920 744 | A1 | 11/1970 |
| DE | 10 2007 024020 | A1 | 11/2008 |
| EP | 1 010 803 | B1 | 6/2000 |
| EP | 1 160 374 | A2 | 12/2001 |
| GB | 2 320 933 | A | 7/1998 |
| JP | S61-34293 | A | 2/1986 |

OTHER PUBLICATIONS

International Search Report of PCT/AT2016/060012, dated Nov. 2, 2016.
Austrian Office Action in A 50649/2015, dated Jun. 2, 2016, with English translation of relevant parts.
Response to EP Patent Office by Applicants's European Attorney in PCT/AT2016/060012, dated Sep. 4, 2017.
International Preliminary Report on Patentability in PCT/AT2016/060012, dated Jan. 25, 2018.
Japanese Examination Report in Japanese Application No. 2018-522822 dated Jul. 30, 2019 with English translation.

* cited by examiner

HYBRID STRANDED CONDUCTOR

CROSS REFERENCE TO RELATED APPLICATIONS

This application is the National Stage of PCT/AT2016/060012 filed on Jul. 21, 2016, which claims priority under 35 U.S.C. § 119 of Austrian Application No. A 50649/2015 filed on Jul. 23, 2015, the disclosure of which is incorporated by reference. The international application under PCT article 21(2) was not published in English.

BACKGROUND OF THE INVENTION

1. Field of the Invention

The invention relates to a hybrid strand comprising a core and outer wires laterally contacting each other and arranged around said core.

Furthermore, a subject matter of the invention is a rope comprising several such hybrid strands.

In addition, the invention also relates to a method for the production of such hybrid strands.

2. Description of the Related Art

A wire rope including an independent wire rope core is known from U.S. Pat. No. 5,946,898 A. Also described is a rope construction made of hybrid strands comprising a fibre core and wires arranged around it; said rope is placed as a core rope inside the wire rope provided as a whole. In case of the known rope, it is intended to prevent the wires or strands from shifting within the rope construction, and it is proposed to compress the entire rope and thereby reduce the cross-section of the compressed rope as compared to the uncompressed rope.

The DE 1 920 744 relates to an aluminium steel overhead rope comprising an aluminium sheath consisting of at least one layer of circular-segment-shaped individual wires, the aluminium layer enclosing the steel core without any essential clearance and being compressed in particular with the steel core by a hydraulic press. The citation relates to a rope, however, not to a hybrid strand. Due to the materials used the rope also has a relatively high weight.

The U.S. Pat. No. 3,142,145 discloses an apparatus for the spiral stranding of a cable core with reinforcing wires having a non-circular cross-section, in particular a trapezoidal cross-section. The reinforcing wires are provided in this given shape on a spool, in order to be stranded with the core. This citation does not relate to a hybrid strand either, but to a cable.

The DE 125643 relates to a suspension cable, for cable railways, whose core is formed by a wire spiral or several intermeshing wire spirals having a common longitudinal axis, in which wire spirals a hemp rope is inserted. Individual profiled wires are stranded around the core made of wire spirals and hemp rope, which profiled wires have an S-shaped cross-section. This citation is not directed to a hybrid strand either.

SUMMARY OF THE INVENTION

However, it is the object of the invention to provide hybrid strands with a comparably small diameter or with a comparably high breaking force, in relation to a given diameter, wherein the hybrid strands or a rope made of these hybrid strands may also have a relatively low weight.

Accordingly, the invention provides a hybrid strand comprising a core and outer wires laterally contacting each other and arranged around said core, wherein it is provided in particular that at least a part of the outer wires is compressed, wherein the compressed outer wires comprise a flattened cross-sectional shape, the outer wires are composed of steel and the core is a fibre core. Of course, the present hybrid strand may comprise several layers of outer wires or wires around the core, wherein in particular the mutual contact of the outer wires in the outer layer at least during the production, and their compression up to a flattening of the cross-section are of importance.

The outer wires may comprise an approximately trapezoidal or circular-segment-shaped cross-sectional shape. Furthermore, in terms of stability and compactness, it is favourable when the outer wires contact each other on the sides in a flat manner. Alternatively, in the hybrid strand, a lateral flattened area of a first compressed outer wire may face a lateral flattened area of an adjacent compressed outer wire at a distance which is essentially constant, preferably in sections. Expediently, the outer wires are made of steel; in particular, the core is a fibre core, that is to say a core made of natural fibres or synthetic fibres, with synthetic fibres being preferred due to their higher load bearing capacity.

The compression (compaction) of the outer wires is effected by means of a compression tool known per se. It is a special feature that in the present case it is not a rope composed of a plurality of hybrid strands that is compressed by means of such a compression tool, as is proposed in the cited U.S. Pat. No. 5,946,898 A, but that components of the rope, i. e. the hybrid strands are compressed already prior to the production of the final rope.

It is to be noted that, as compared to compressed ropes which are entirely composed of steel, ropes made of uncompressed hybrid strands comprise a comparatively low breaking force, with the diameter being the same. To obtain a breaking force that is comparable to that of ropes that are entirely composed of steel, an uncompressed hybrid rope must have a larger diameter, thus causing a higher weight, apart from the additional costs of such a rope.

Due to the compression of the hybrid strands which is provided here, the outer wires are cold-formed and the cross-section of the outer wires is flattened, whereby starting from a round cross-section in particular an approximately trapezoidal or circular-segment-shaped cross-section is obtained. It is essential that the cavities between the wires are minimized by the compressing process, whereby the relative metallic cross-section and thus the breaking force of the hybrid strand is increased significantly.

Thus, with the present hybrid strands a comparably light, compressed hybrid rope may be obtained, which may have a lower weight per length unit as well as a higher specific strength as compared to a compressed steel rope, with the rope nominal diameter being the same.

The rope composed of the present hybrid strands may advantageously be an anti-twist rope, i. e. the torques of the hybrid strands may counterbalance or at least mainly compensate each other when the hybrid strands are arranged accordingly within the rope, other than in the case of conventional hybrid ropes, in which a fibre core is surrounded by wire strands composed entirely of steel, whereby no absence of torsion (twist) may be achieved, since the torques of the fibres and of the steel wires differ from each other too much. In the method according to the invention for the production of the hybrid strands, wires or outer wires, respectively are wrapped around a core and compressed, in particular around a fibre core, wherein the outer wires have at least almost contact in the state when still uncompressed, during compression contact each other in a lateral contact area, preferably in a flat manner and wherein at least part of the outer wires comprises a flatted cross-sectional shape in the contact area after compression.

In the case of the compressed wire strands any inner wires are supposed to have the same transverse pressure stiffness as the outer wires, i. e. the wires of the outer wire layer, and thereby the wires are able to build up the counter pressure required for deforming the outer wires. A fibre core per se, however, could not withstand the external pressure of a compression tool (e. g. rolls, draw die or hammers); instead, the fibre core will yield. Thus, the outer wires cannot be deformed sufficiently. After "compression", i. e. passing of a compressing tool, the hybrid strand may spring back, i. e. when the counter pressure is built up by the fibre core only, the wires again move radially outwards after compression, and there will not remain any significant deformation of the wires. In the present method, however, the fibre core will only yield to such an extent until the wires, in particular wires of an outer layer in the case of several layers of wires, completely contact each other. It is particularly favourable when these outer wires support each other during the compression in a vault-like manner. Due to this mutual support of the wires as a result of the vault formation, the entire radial pressure will act upon the outer wire layer upon compression, and the desired plastic cold forming of the outer wires may take place. If prior to the vault formation the wires have been pressed a bit against the fibre core during compression, they may spring back to some extent after compression, so that the deformed wires of the compressed hybrid strand may slightly be spaced apart.

To obtain this "vault formation" a corresponding number of outer wires is to be provided, with an adequate wire diameter and an adequate lay angle of the rope wires, as may easily be found out in practice depending on the entire dimensions of the rope to be produced.

For example, the combination of eleven wires having a diameter of 0.85 mm and a lay angle of 17° proved to be favourable to produce a compressed hybrid strand having a diameter of 3.8 mm. The number of outer wires, however, may range from e. g. 3 to 20, whereby the range from 8 to 14 has proven to be particularly favourable due to the weight distribution between the fibre core and the outer wires. Depending on the number of wires the lay angles may range from 5° to 30°, whereby the range from 15° to 25° has proven to be particularly favourable. Depending on the choice of the wire diameters, hybrid strands having different diameters are produced. The extent of compression is determined by dimensioning the initial and final diameters accordingly. Here, a diameter reduction of the strands is possible by means of a compression in the range from 2% to 20% depending on the number of outer wires, whereby the range from 4% to 10% has proven to be favourable.

On the whole, ropes comprising hybrid strands can be obtained by the present method, wherein steel wires are being used, whereby the weight of the ropes is approximately 30% lower if the ropes have the same breaking force as a conventional steel rope or at a corresponding, approximately identical weight the ropes have a comparably essentially higher breaking force.

BRIEF DESCRIPTION OF THE DRAWINGS

The present invention will be described in more detail on the basis of preferred embodiments, to which it is not limited, however, with reference being made to the enclosed drawings, in which.

DETAILED DESCRIPTION OF THE PREFERRED EMBODIMENTS

Figure 1:
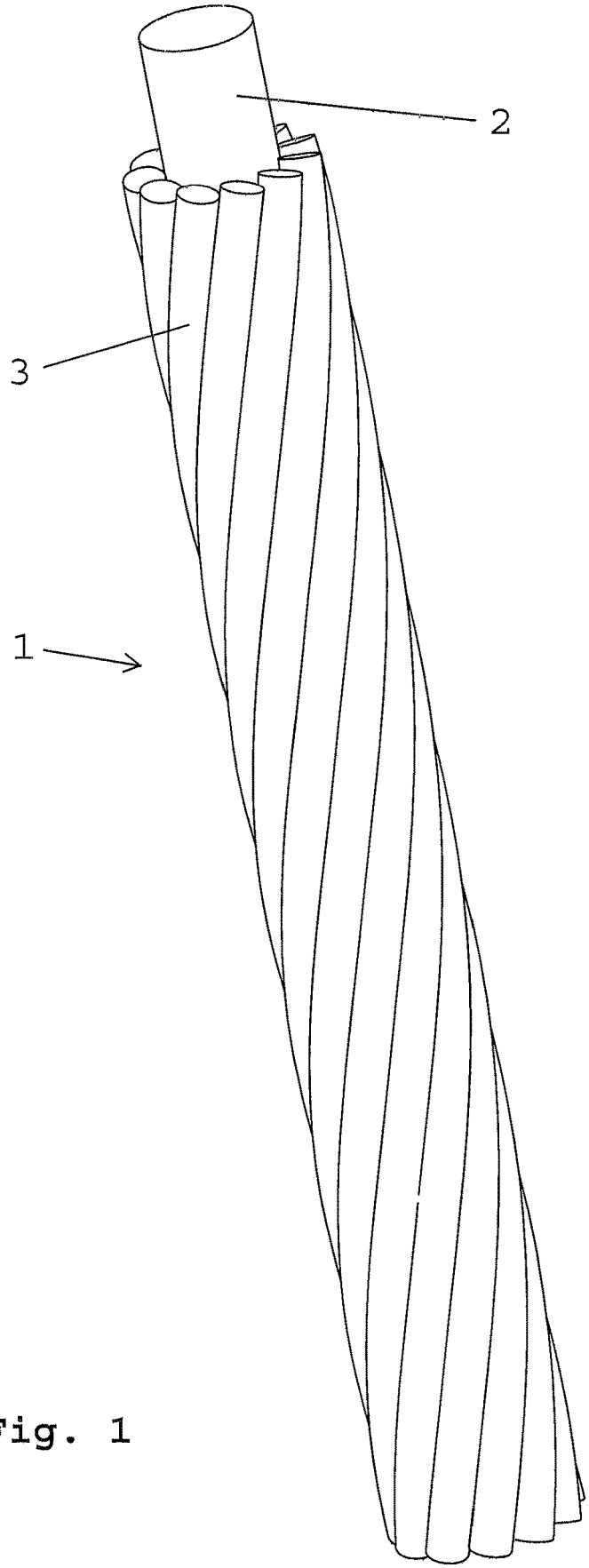
FIG. 1 schematically shows an axonometric view of a portion of a hybrid strand still prior to the compression of the outer wires.

FIG. 1 schematically shows a part of a hybrid strand 1 in a diagrammatic view. This hybrid strand 1 comprises a fibre core 2 as well as steel wires 3 wrapped around this fibre core 2, wherein in the example shown in FIG. 1 only one layer of wires (outer wires) 3 is shown. However, it would also be conceivable to provide here (just like in the subsequent examples) two or more layers of wires, with an outer layer of wires 3 that are cold-formed in the subsequent compression. Such cold forming may be gathered from the view shown in FIG. 2, where it may be seen that the wires 3' around the fibre core 2, after compression, now abut to each other with their sides in a flat manner and have an approximately trapezoidal cross-section. On the whole, the hybrid rope or the hybrid strand 1 now has a smaller cross-section as compared to FIG. 1, with a compression of the (outer) wire layer 4 comprising the wires 3'.

Figure 2:
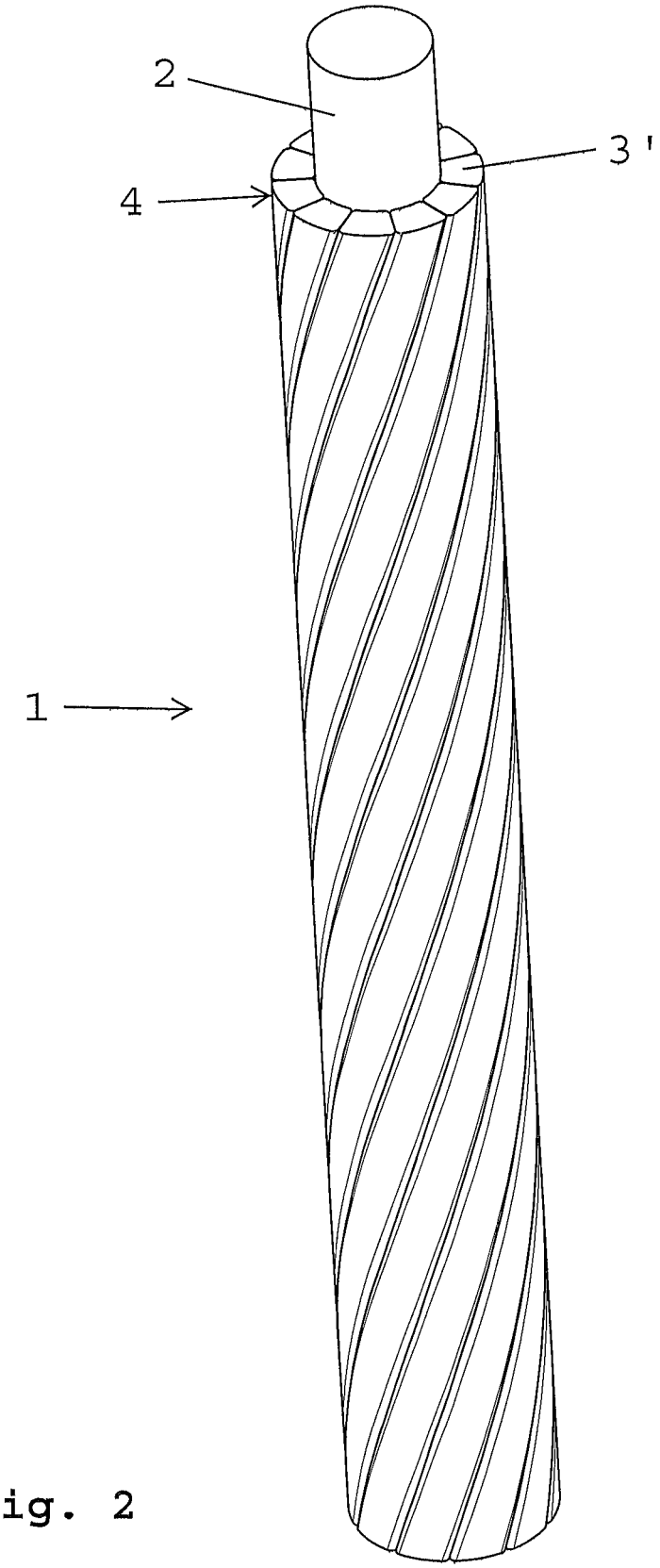
FIG. 2 shows an identical axonometric view of said hybrid strand after the compression of the wires of the outer layer.
Figure 3:
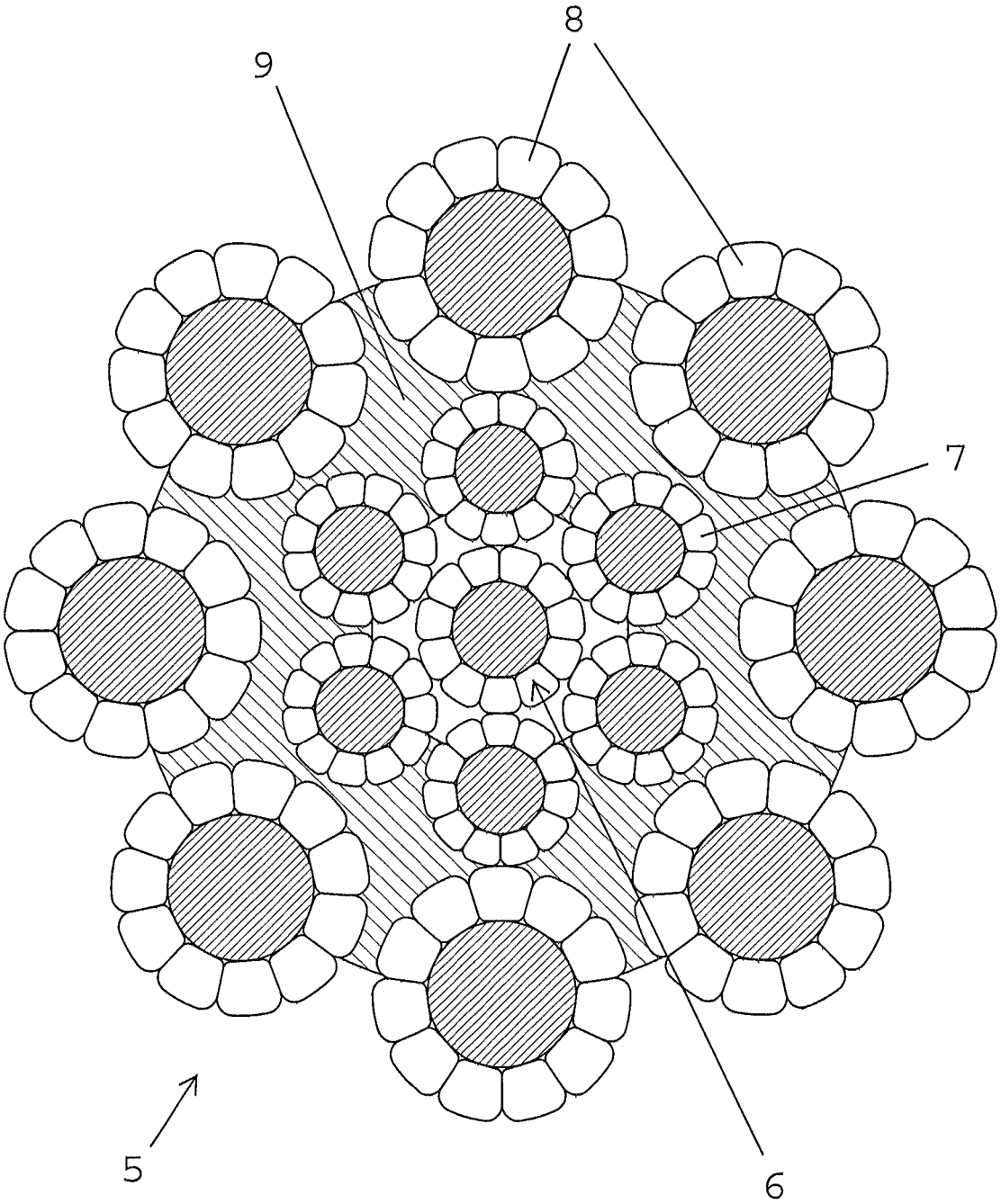
FIG. 3 shows a cross-section through a non-anti-twist hybrid rope with such hybrid strands.

FIG. 3 shows a cross-section through a hybrid rope 5 which is not torsion-free in this embodiment and in which compressed hybrid strands 1 according to FIG. 2 have been used. Specifically, a core hybrid strand 6 is provided, around which six hybrid strands of an inner strand layer 7 are arranged. Finally, an outer layer 8 is provided with eight hybrid strands 1 (according to FIG. 1), wherein a plastic intermediate layer 9 supports the outer hybrid strands 1 of this outer layer 8, as is known as such.

Figure 4:
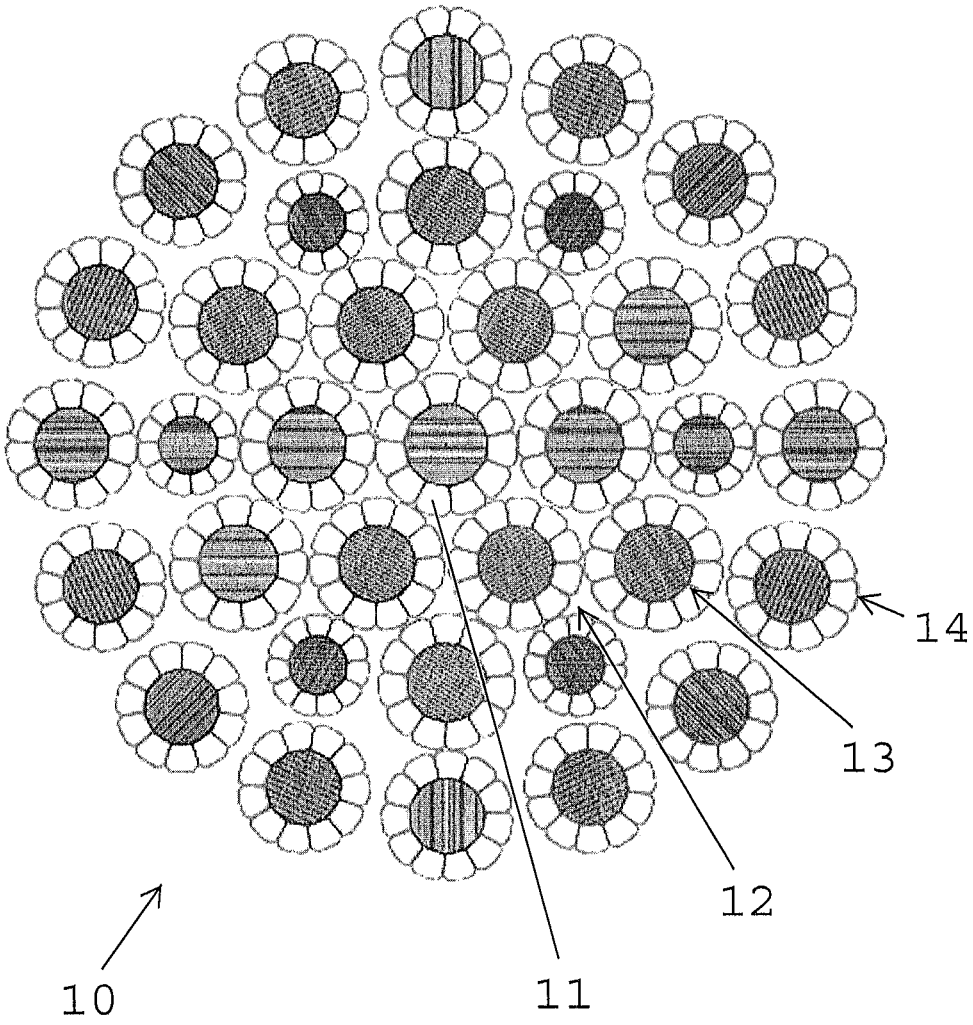
FIG. 4 shows an anti-twist hybrid rope using such hybrid strands.

For the purpose of comparison, FIG. 4 shows a cross-section through a torsion-free hybrid rope 10, wherein comparable hybrid strands 1 (cf. FIG. 2) are used, on the one hand, for the core 11 of the rope 10 and, on the other hand, for the construction of a total of three strand layers 12, 13 and 14. The hybrid strands (1 in FIG. 2) also have different diameters to obtain a compact construction.

The hybrid rope 10 according to FIG. 4 is torsion-free, with no plastic intermediate layer or support body being used, such as is shown in the case of the rope 5 according to FIG. 3. The cross-sections according to FIG. 3 and FIG. 4 are examples of possible rope constructions, wherein of course different types of other rope constructions are possible.

As may be seen in particular from FIG. 2, more compact cross-sections can be obtained by the compression of the hybrid strand 1 or the cold forming of the outer wires 3', whereby the entire cross-section of the hybrid strand 1 is reduced, and whereby the cross-sections of the wires 3 change from a round cross-sectional shape to an approximately trapezoidal or circular-segment shape (wires 3'). The cavities between the wires 3 or 3' are reduced by the compression process, whereby the relative metallic cross-section and thus also the breaking force of the hybrid strand 1 is increased essentially. On the whole, ropes 5 and 10, respectively are made possible in this manner, which may have a weight that is about 30% lower in the case of a breaking force identical to that of a conventional steel rope or vice versa may have an essentially higher breaking force in the case of the same weight.

The following table 1 shows a comparison of values for a conventional compressed steel rope and a compressed hybrid rope, for example according to FIG. 3.

TABLE 1

| | steel rope | | Compressed hybrid rope | |
|---|---|---|---|---|
| Rope nominal diameter | Weight per meter | Specific strength | Weight per meter | Specific strength |
| 24 mm | 2.75 kg/m | 188 kN/kg | 1.95 kg/m | 265 kN/kg |

The compressed hybrid rope has a specific strength that is 40% higher compared to a compressed rope that is entirely composed of steel.

A comparison of a compressed and a non-compressed hybrid rope (with identical breaking force) will result—according to table 2—in the following nominal diameter of the rope.

TABLE 2

| Hybrid rope compressed Nominal Ø of rope | Hybrid rope uncompressed Nominal Ø of rope |
|---|---|
| 24 mm | 25.25 mm |

It is added for the sake of completeness that "specific breaking force" means the ratio between the general breaking force and the weight per meter of a rope.

Figure 2A:
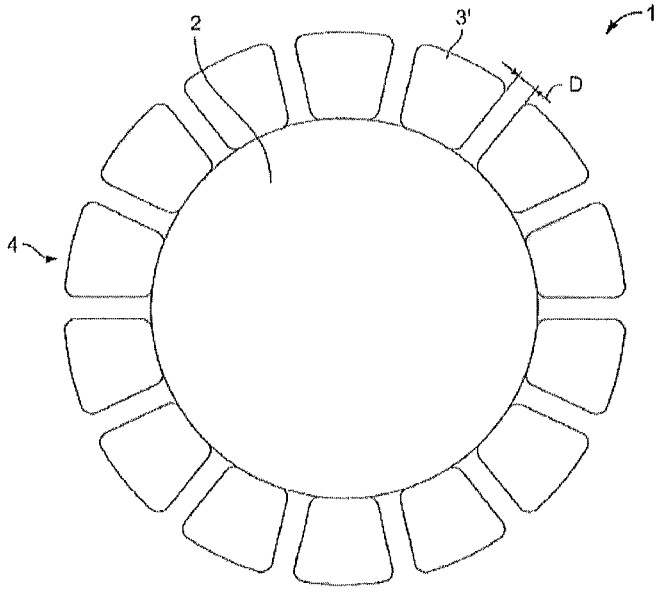
FIG. 2A shows a cross-sectional view of the hybrid strand wherein the distance between adjacent deformed outer wires is shown excessively large only for illustrative purposes.

As stated previously, in the present method, the fiber core will yield only to such an extent until the wires, in particular wires of an outer layer in the case of several layers of wires, completely contact each other. It is particularly favorable when these outer wires support each other during the compression in a vault-like manner. Due to this mutual support of the wires as a result of the vault formation, the entire radial pressure will act upon the outer wire layer upon compression, and the desired plastic cold forming of the outer wires may take place. If prior to the vault formation the wires have been pressed a bit against the fibre core during compression, they may spring back to some extent after compression, so that the deformed wires of the compressed hybrid strand may slightly be spaced apart by a distance D. See FIG. 2A.

The invention claimed is:

1. Hybrid strand comprising a core and outer wires arranged around said core, wherein at least a part of the outer wires is compressed, the compressed outer wires comprise a flattened cross-sectional shape, the outer wires are composed of steel and the core is a fiber core, wherein a first compressed outer wire is spaced apart from an adjacent compressed outer wire, and wherein a lateral flattened area of the first compressed outer wire faces a lateral flattened area of the adjacent compressed outer wire at a distance.

2. Hybrid strand according to claim 1, wherein the compressed outer wires comprise a trapezoidal or circular-segment-shaped cross-section.

3. Hybrid strand according to claim 1, wherein the distance between the facing flattened areas is constant at least in sections.

4. Rope comprising several hybrid strands according to claim 1.

5. Rope according to claim 4 in the form of an anti-twist rope.

6. Method for the production of a hybrid strand, wherein outer wires made of steel are wrapped and compressed around a fiber core, wherein the outer wires during compression contact each other in a lateral contact area, wherein after compression at least a part of the outer wires comprises a flattened cross-sectional shape in the contact area, wherein the outer wires support each other in a vault-like manner during the compression, and wherein the outer wires are pressed against the fiber core during compression prior to the vault formation and spring back to a corresponding extent after compression, so that the deformed outer wires of the compressed hybrid strand are spaced apart.

* * * * *